United States Patent [19]

Golata

[11] 4,170,888

[45] Oct. 16, 1979

[54] APPARATUS FOR SPIN-FORMING WHEEL RIMS

[75] Inventor: John H. Golata, Lansing, Mich.

[73] Assignee: Motor Wheel Corporation, Lansing, Mich.

[21] Appl. No.: 920,650

[22] Filed: Jun. 30, 1978

[51] Int. Cl.[2] ..... B21D 22/16

[52] U.S. Cl. ..... 72/82; 72/84; 279/1 C

[58] Field of Search ..... 72/82, 83, 84, 85, 105, 72/106; 279/1 C

[56] References Cited

U.S. PATENT DOCUMENTS

| | | | |
|---|---|---|---|
| 1,680,061 | 8/1928 | Nelson | 72/80 |
| 1,828,464 | 10/1931 | Harrison | 72/82 |
| 2,207,621 | 7/1940 | Hite | 279/1 C |
| 2,345,786 | 4/1944 | Berg | 279/1 C |
| 2,593,706 | 4/1952 | VonZelewsky | 279/1 C |
| 3,369,388 | 2/1968 | Jepson | 72/367 |
| 3,625,528 | 12/1971 | Sage | 279/1 C |
| 4,040,281 | 8/1977 | Meyer | 72/82 |

*Primary Examiner*—Lowell A. Larson

*Attorney, Agent, or Firm*—Barnes, Kisselle, Raisch & Choate

[57] ABSTRACT

In an apparatus for spin-forming a drop-center wheel rim which includes axially reciprocable head and tail stock sections, a centrifugally actuated clamp is mounted on the tail stock section and is adapted to engage an internal groove in the head stock section as the sections are conjointly rotated to prevent axial movement therebetween during the high-speed spin-forming operation.

9 Claims, 3 Drawing Figures

APPARATUS FOR SPIN-FORMING WHEEL RIMS

The present invention is directed to spin-forming apparatus, and more particularly to improved apparatus for spin-forming wheel rims of the drop-center type.

An object of the present invention is to provide a spin-forming apparatus particularly adapted for formation of drop-center wheel rims which includes a clamp or lock automatically responsive to rotation of the head and tail stock sections for clamping the sections together against relative axial movement.

The invention, together with additional objects, features and advantages thereof, will be best understood from the following description, the appended claims and the accompanying drawings in which:

Figure 1:
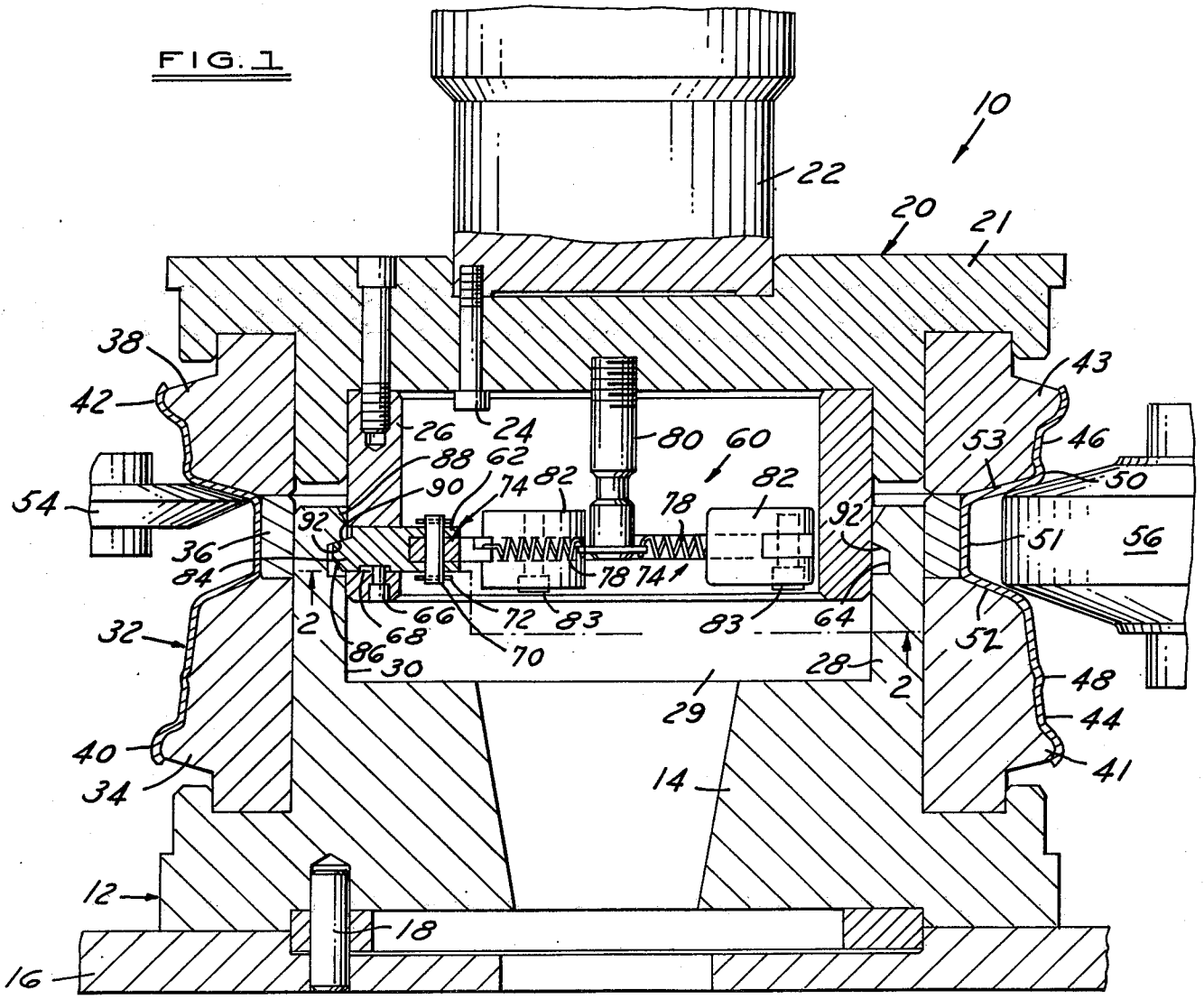
FIG. 1 is a plan view generally horizontally bisecting a wheel forming apparatus in accordance with the invention.

Referring to the drawings, a presently preferred embodiment 10 of the wheel forming apparatus provided by the invention includes a head stock section 12 comprising a mandrel 14 mounted on a rotatable backing plate 16 and centrally located thereon as by pins 18. A tail stock section generally indicated at 20 includes a mandrel 21 mounted on a rotatable spindle 22 as by bolts 24 and carrying an axially projecting sleeve 26. An axially projecting lip 28 on head stock mandrel 14 defines an inner cavity 29 bounded by a cylindrical surface 30 for telescopically receiving tailstock sleeve 26. The head and tail stock sections are adapted to rotate coaxially and conjointly, and tail stock section 20 is adapted to reciprocate in the direction of the axis of rotation (the axis of spindle 22 in FIG. 1 between a closed position illustrated in FIG. 1 and an open position, (not shown). In the open position, the head and tail stock sections are separated by a distance sufficient to permit a preformed rim blank 32 (FIG. 3) to be located between the head and tail stock sections. The axis of rotation of the head and tail stock sections is preferably horizontal, although a vertical or angulated axis of rotation may be utilized without departing from the scope of the present invention.

The die sections 34,36 and 38 are carried by the head and tail stock sections, die sections 34 and 36 being mounted on head stock mandrel 14 and die section 38 being mounted on tail stock mandrel 21. Die sections 34,36 and 38 collectively define in the closed position illustrated in FIG. 1 a desired wheel rim contour. In the specific embodiment illustrated, the die sections define a contour for forming the wheel flanges 40,42, tire bead seats 44,46 adjacent the flanges and tire bead retaining safety lips 48,50 adjacent the bead seats. Die section 34 mounted on head stock mandrel 14 and die section 38 mounted on tail stock section 20 also define surfaces for forming opposing side walls 52,53 of the wheel drop center well 51. One or more forming rollers 54 (FIG. 1) are carried externally of sections 12,20 and are adapted to move radially into rolling engagement with a rim blank 32 when the latter is located between the head and tail stock section, and then to move axially or transversely across the rim blank while pressing the blank radially inwardly against the surfaces of the die sections for forming a wheel rim of desired contour.

Figure 3:
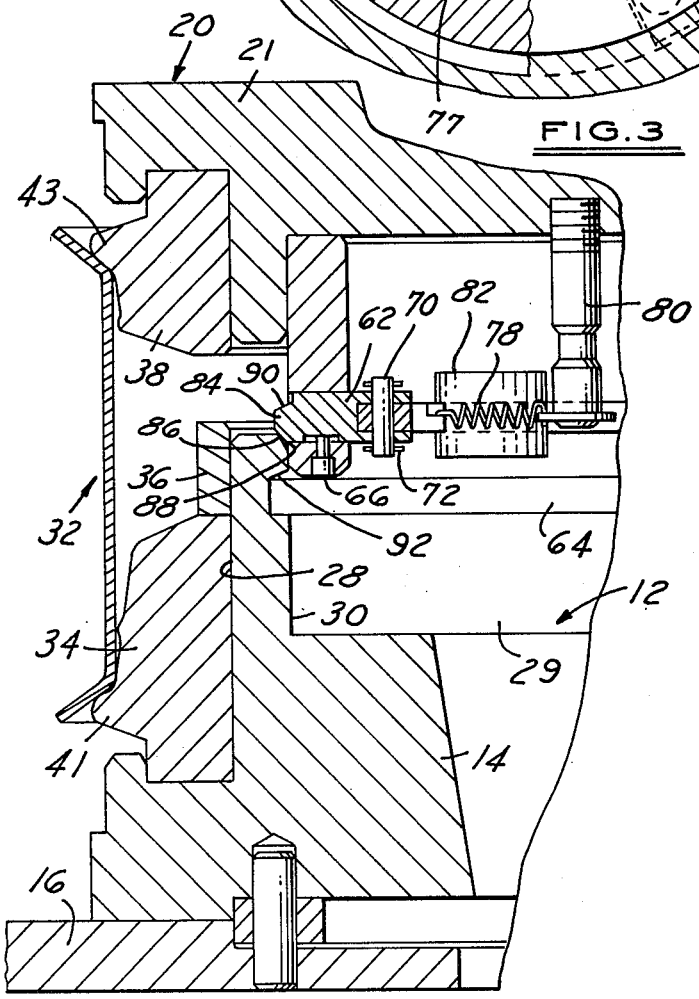
FIG. 3 is a fragmentary sectional view, sectioned as in FIG. 1 of a portion of the apparatus illustrated in FIG. 1 at an intermediate stage of operation.

In operation as thus far described, a rim blank 32 is first located between the head and tail stock sections, and the tail stock section is displaced axially toward the head stock section to the position illustrated in FIG. 3 wherein the rim blank is captured between the die projections 41,43 for forming wheel flanges 40,42 (FIG. 1). At this point, corotation of the head and tail stock sections is initiated at low speed and the forming roller 54 is brought into engagement with the rim blank for forming the wheel drop center. As the drop center is being formed by forcing the rim blank radially inwardly toward die section 36, the tail stock section is displaced axially toward the head stock section until the fully closed position illustrated in FIG. 1 is reached. At this point, a back-up idling roller 56 is moved radially into engagement with opposing walls 52,53 of the drop center or well to hold the workpiece against the die surfaces. The speed of rotation of the head and tail stock sections is then increased, and the forming roller 54 is axially reciprocated through several passes across the workpieces to form the wheel bead seats and flanges, etc. For a general teaching of rim-forming apparatus as thus far described, reference may be had to the U.S. Pat. of the inventor herein No. 3,255,518, the disclosure of which is incorporated herein by refernce.

It has been found in wheel forming apparatus of the described type, particularly for a drop-center wheel rim, that large die-opening forces are developed during high-speed operation which tend axially to separate the head and tail stock sections from each other. These forces are believed to result from the conjoint action of the forming wheel 54 and back-up roller 56 against the workpiece and the die surfaces, and the centrifugal forces on the rim blank itself. The tail stock section is conventionally moved and held against the head stock section by a high pressure hydraulic cylinder, the pressure in which is sufficient to move the tail stock section and hold it in position during low-speed operation. During high-speed operation, however, this holding pressure has been found to be insufficient. To modify the hydraulic drive mechanism to develop higher pressure would be possible, but would be inefficient and uneconomical since the higher pressure is needed only to perform a holding function during only a portion of the machine cycle.

Figure 2:
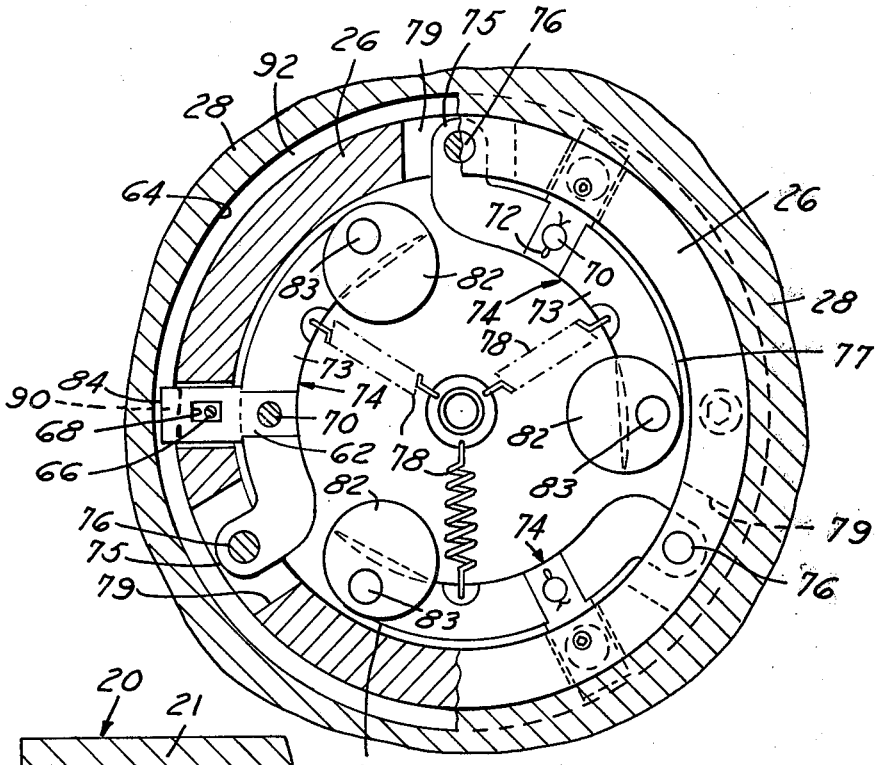
FIG. 2 is a sectional view taken along the line 2—2 in FIG. 1.

In accordance with the present invention, a centrifugally actuated clamp 60 is mounted on tail stock mandrel 21 and is adapted to engage the head stock mandrel to prevent axial movement therebetween during the highspeed spin-forming operation. Clamp 60 includes three circumferentially spaced fingers 62 which extend radially through corresponding apertures in sleeve 26 retractively to engage radially a inwardly facing circumferential channel or internal groove 64 in head stock mandrel surface 30. Three pins 66 spaced 120° from each other extend through the end of sleeve 26 axially individually into corresponding slots 68 in each finger 62 for restraining movement of the respective fingers in the radial direction and also to define limits to such radial movement. Each finger 62 is mounted by a corresponding pivot pin 70 and a cotter key 72 to the central portion 73 of an arcuate lever arm 74. Arms 74 are arcuate substantially coaxially with mandrel cavity 29 in the closed and locked position best seen in FIG. 2. The lever arms 74 are pivotally mounted at one end 75 in recesses or openings 79 (FIG. 2) in tail stock sleeve 22 by pivot pins 76 extending through the sleeve and into the openings. Arms 74 are normally biased radially inwardly to a retracted position (not shown) by respective tension coil springs 78 connected between lever arm portions 73 and a central mounting pin 80. A weight 82 is mounted to each arm 74 by a screw 83 at the arm free end 77 remote from the corresponding pivot pin 76. Thus, centrifugal force on weight 82 and arm 74 resulting from rotation of tail stock section 20 causes outward movement or expansion of the lever arms, the arms thus operating as levers of the second class against the force of springs 78 to bring fingers 62 into locking engagement with groove 64.

The groove-engaging end 84 of each finger 62 is beveled as at 86 (FIGS. 1 and 3) at the outer corner remote from tail mandrel 21 to ride over the correspondingly opposing beveled edge 88 of head stock mandrel lip 28 as the head and tail stock sections come together during low-speed operation as illustrated in FIG. 3. Thus, if the clamp is actuated during low-speed operation, the fingers are cammed radially inwardly against the centrifugal force on weights 82 and arms 74 as the fingers ride over the head stock mandrel lip 28, and then expand radially outwardly to the locked position of FIG. 1 when the fingers become radially aligned with groove 64. Note that the outer edge of finger end 84 adjacent head stock mandrel 21 is beveled at 90 to cooperate with a correspondingly beveled wall 92 of groove 64 so as to wedge the locking pins and the tail stock section more firmly against the head stock sections as a function of angular velocity. When the spin-forming operation has been completed, rotation of the head and tail stock sections, is stopped, tail stock section 20 is retracted, and the finished wheel rim is removed.

Thus, there has been provided in accordance with the invention a centrifugally actuated clamp which automatically lock together the head and tail stock sections of an apparatus for high-speed spin-forming of a drop center wheel rim. The clamp is automatically responsive to the speed of rotation and requires no operator intervention. The clamp is carried internally of the nested head and tail stock sections to help discourage tampering and not interfere with the actual forming operation.

I claim:

1. An apparatus for spin-forming wheel rims and including rotatable head and tail stock sections axially reciprocable with respect to each other between open and closed positions, die means carried by said head and tail stock sections and adapted in said closed position of said sections to define a selected wheel rim contour, and forming means disposed externally of said head and tail stock sections and adapted to cooperate with said die means for forming a wheel rim of said contour during rotation of said sections, the improvement comprising locking means carried by one of said head and tail stock sections and responsive to centrifugal forces generated during corotation of said sections to lock said one section to the other of said sections in said closed position.

2. Apparatus as set forth in claim 1 wherein said locking means includes first means carried by said one of said sections for pivotal movement radially of said one section is response to rotation of said one section and second means carried by said other section to capture said first means.

3. Apparatus as set forth in claim 2 wherein said first means includes a plurality of arms carried by said one section for radially outward pivotal motion, spring means carried by said one section inwardly biasing said arms, and locking fingers carried by said arms for radially outward motion when outward centrifugal force on said arms and fingers overcomes the inward biasing force of said springs.

4. Apparatus as set forth in claim 3 wherein said second means comprises a radially inwardly directed aperture means adapted to receive said locking pins.

5. Apparatus as set forth in claim 4 wherein said head stock section includes a head stock mandrel with a cavity having an internally facing cylindrical wall, said aperture means comprising an inwardly directed circumferential groove extending around said cylindrical wall, and wherein said tail stock section includes a tail stock mandrel having a portion including said first means adapted to be received coaxially within said cavity.

6. Apparatus as set forth in claim 5 wherein said arms are arcuate substantially coaxially of said tail stock mandrel in the outer pivotal position of said arms.

7. Apparatus as set forth in claim 6 wherein said first means comprises an evenly spaced circumferential array of three arcuate arms, each said arm being pivotally mounted at one end to said tail stock section, means providing weight carried at the pivot-remote free end of each said arm, and a locking finger projecting radially outwardly from a central portion of each said arm.

8. Apparatus for spin-forming metal drop-center wheel rims for tubeless tires comprising rotatable head and tail stock sections reciprocable in the direction of the axis of rotation between a closed position and an open position in which said section are separated by a distance sufficient to permit a rim blank to be located between said sections, first and second die means respectively carried by said head and tail stock sections and adapted in said closed position conjointly to define a selected wheel rim contour, said first and second die means respectively defining opposing side walls of a wheel drop-center, forming means disposed externally of said head and tail stock sections and adapted to reciprocate axially for forming a wheel rim over the contour of said first and second die means during high-speed corotation said head and tail stock section such that forces are developed by the conjointly action of said forming means on a rim blank and centrifugal forces on said rim blank which tend axially to separate said head and tail stock sections, and locking means responsive to rotation of said head and tail stock sections for locking said sections together against said separating forces.

9. Apparatus as set forth in claim 8 wherein said locking means comprises a centrifugal lock operable above a given angular velocity of said sections to effect said locking action.

* * * * *